United States Patent [19]

Johnson et al.

[11] 4,091,753

[45] May 30, 1978

[54] BOBBIN THREAD PULL-OFF FOR LOCKSTITCH LOOPTAKER

[75] Inventors: Ralph Edward Johnson, Convent Station; Donald Rodda, Butler, both of N.J.

[73] Assignee: The Singer Company, New York, N.Y.

[21] Appl. No.: 759,515

[22] Filed: Jan. 13, 1977

[51] Int. Cl.[2] ..... D05B 57/14

[52] U.S. Cl. ..... 112/184; 112/231

[58] Field of Search ..... 112/184, 229, 181, 186, 112/224, 230, 231

[56] References Cited

U.S. PATENT DOCUMENTS

| | | | |
|---|---|---|---|
| 2,505,523 | 4/1950 | Robert | 112/184 |
| 2,742,008 | 4/1956 | Enos | 112/229 |
| 3,051,108 | 8/1962 | Ketterer | 112/181 |
| 3,138,127 | 6/1964 | Ketterer | 112/184 |
| 3,334,604 | 8/1967 | Ivanko | 112/181 |
| 3,407,760 | 10/1968 | Ketterer | 112/184 |
| 3,693,566 | 9/1972 | Ketterer | 112/186 X |

FOREIGN PATENT DOCUMENTS

| | | | |
|---|---|---|---|
| 1,037,825 | 8/1958 | Germany | 112/229 |

*Primary Examiner*—Werner H. Schroeder
*Assistant Examiner*—Moshe I. Cohen
*Attorney, Agent, or Firm*—Edward P. Schmidt; Edward L. Bell; Robert E. Smith

[57] ABSTRACT

A bobbin thread pull-off, attachable to a rotating lockstitch looptaker in a location to pull bobbin thread from a bobbin after the previous stitch has been set. The pull-off and attachment means are given a thread handling finish prior to assembly to a completed looptaker, no other finishing operations being required after assembly thereto.

3 Claims, 9 Drawing Figures

BOBBIN THREAD PULL-OFF FOR LOCKSTITCH LOOPTAKER

BACKGROUND OF THE INVENTION

The invention relates to a lockstitch sewing machine rotating looptaker, more particularly, to a bobbin thread pull-off for such a looptaker.

A lockstitch is formed by concatenation of an upper, or needle thread with a lower, or bobbin thread. A looptaker is provided to pick up a loop of the needle thread carried through the work material by the sewing needle, enlarge the loop and cast it about a thread carrying bobbin supported internally of the looptaker. A sewing machine take-up lever is provided for the needle thread, to supply the needle thread required for the enlarged loop, and to take up the excess needle thread when the loop has been cast about the bobbin. When the excess needle thread is taken up by the take-up lever, it carries with it a bobbin thread, about which it is now looped. In subsequent stitches, the bobbin thread extends from the stitching to the bobbin and the needle thread loop must pull against the bobbin thread to be drawn, by the take-up lever, to the work material. As the needle thread loop about the bobbin thread becomes smaller, there is greater resistance to relative movement of the threads, a condition which becomes more severe as machine speed is increased. Even at constant machine speed, this condition creates a difficulty in making uniformly set stitches, the difficulty being compounded by zig-zag or pattern stitching where thread demand is increased.

In the prior art, this condition has been alleviated by providing means for pulling off bobbin thread from the bobbin; to, in theory, remove bobbin inertia and thread tension as a factor in the thread lock-up, thereby permitting easier flow of the bobbin thread. Some prior art machines with bobbin thread lead directly below a feed dog, have accomplished this by utilizing part of the feed dog return motion to pull off bobbin thread from the bobbin, requiring, however, extra mechanism or other design restraints. In U.S. Pat. No. 3,693,565, there is disclosed a lockstitch looptaker with bobbin thread lead between a bobbin case and looptaker body, wherein frictional surfaces on the looptaker body periodically engage with the bobbin thread to perform a pull off function. It is also known to provide a looptaker having a portion thereof contoured in a fashion to provide a positive pull off for bobbin thread, and also biasing the bobbin thread lead to one side of the sewing needle path to prevent half hitching. In this latter looptaker, however, considerable care and expense is required to insure that the pull off portion thereof is properly formed yet will not fray or weaken the bobbin thread.

What is required is a bobbin thread pull-off associated with a looptaker to work in conjunction therewith, without the necessity for careful or expensive finishing operations to insure the proper functioning thereof.

SUMMARY OF THE INVENTION

The above desired ends are achieved in a looptaker finished in the traditional manner for thread handling and with a prepared surface, such as a milled slot, for a separately finished bobbin thread pull-off and attachment means. The embodiment in which the invention is incorporated utilizes a vertical axis rotary looptaker, rotating in a 2 to 1 ratio with needle bar reciprocations, i.e., two rotations of the looptaker for each endwise reciprocation of the needle bar. There is supported in the looptaker, against rotation therewith, a bobbin case carrying a bobbin. Thread from the bobbin is passed through a bobbin thread tension means affixed to the bobbin case and passes from the tension means beneath the bobbin case to the stitching point on the side of the bobbin case opposite the bobbin thread tension means. The side of the bobbin case opposite the bobbin thread tension means extends deeper into the looptaker in order to force the bobbin thread to extend into the path of the bobbin thread pull-off supported on the looptaker body. The bobbin thread pull-off is attached to the looptaker body in a location to act on the bobbin thread well after the previous stitch has been set. The bobbin thread pull-off is L-shaped with a reentrant angle, and is held attached to the looptaker body by, for example, a flat head machine screw sitting in a tapered bore in the pull-off. The upstanding portion of the pull-off is at an angle of approximately 60° with the attachment leg, and has an upper edge formed with a hook shape, to draw bobbin thread of a newly introduced bobbin to a proper operating position. After the previous stitch has been set, the leading edge of the upstanding portion of the pull-off contacts the bobbin thread extending between the previous stitch and the bobbin tension supported on the bobbin case; and, as the rotation of the looptaker continues, pulls a supply of bobbin thread from the bobbin through the bobbin tension. The pull-off, as accomplished, also positions the bobbin thread lead to the left of the sewing needle, obviating half-hitching. Needle penetration of the work material occurs shortly after the pull-off of bobbin thread has taken place, the pull-off then making an idle revolution due to the slack in the bobbin thread introduced in the prior revolution. All parts of the bobbin thread pull-off and attachment means are given a thread handling finish, as is the looptaker, prior to assembly to the looptaker, with no further finishing required after assembly.

With the above and additional objects and advantages in view, as will hereinafter appear, this invention will now be described with reference to the accompanying drawings of a preferred embodiment in which:

FIG. 1 is a top plan view of a sewing machine rotary looptaker together with mechanism for constraining a bobbin carrying bobbin case in place in the rotary looptaker and showing the position of the bobbin thread pull-off after a loop of needle thread has been seized by the looptaker beak;

FIG. 2 is a cross sectional view of the rotary looptaker, bobbin case and bobbin taken substantially along line 2—2 of FIG. 4, and including fragments of the needle and throat plate;

FIG. 3 is a top plan view of the rotary looptaker of FIG. 1 together with only a fragment of the bobbin case showing the bobbin thread tensioning means of the bobbin case and indicating the path of the bobbin thread therefrom when a stitch is being set into the work fabric;

FIG. 4 is a top plan view of the rotary hook similar to FIG. 3 but showing the path of the bobbin thread just after needle penetration of the work fabric;

FIG. 5 is an elevational view of the bobbin thread pull-off taken substantially along line 5—5 of FIG. 3;

FIG. 6 is an elevational view of the bobbin thread pull-off taken substantially along line 6—6 of FIG. 3;

FIG. 7 is a top plan view of a prior art rotary looptaker;

FIG. 8 is a cross sectional view of the prior art looptaker taken substantially along line 8—8 of FIG. 7; and, FIG. 9 is a partial head end elevation of a sewing machine with a take-up lever in the stitch setting position.

DESCRIPTION OF THE DRAWINGS

The looptaker illustrated in the drwawings is adapted for use with a sewing machine such as is disclosed in the U.S. Pat. No. 2,862,468, Dec. 2, 1958, of R. E. Johnson which is hereby incorporated by reference and made a part of this application. The above cited patent may be referred to for disclosure of all of the sewing machine mechanism save for details of the looptaker and mechanism directly related with the looptaker such as the bobbin thread replenishing mechanism. Thus, as is shown in the above cited patent, the looptaker 10 is a vertical axis looptaker journaled for rotation in the bed of a sewing machine to cooperate with an endwise reciprocating needle 12 in the formation of lockstitches. The looptaker 10 disclosed in the drawings is a rotary hook, to which is imparted turning movement in a counter-clockwise direction during operation of the sewing machine, preferably partaking of two revolutions during each cycle of endwise reciprocation of the needle 12, which cooperates therewith in the formation of stitches by passing through a needle hole 14 in a throat plate 15 (see FIG. 2). The looptaker 10 of this invention represents an improvement to the prior art looptaker disclosed in the U.S. Pat. No. 3,693,565, Sept. 26, 1972 of Ketterer, assigned to the assignee of the instant invention, which is hereby incorporated by reference and made a part of this application.

Figure 5:
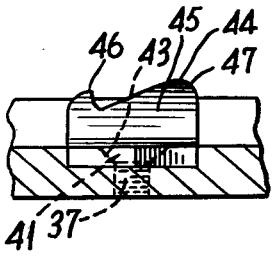
Figure 6:
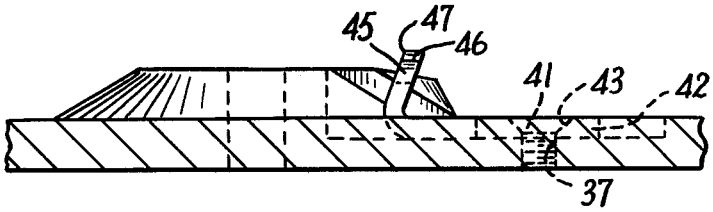

The cup-shaped rotary looptaker 10 includes an internal base portion 24 having a large essentially circumferential opening 25 therethrough to accommodate the endwise reciprocation of the sewing needle 12. Extending from an external base portion 28 of the looptaker 10 is a hollow looptaker shaft 30 which is supported for rotation in a bearing in the bed of the sewing machine, and has a bevel gear fixed to the end thereof to be driven by the drive means of the sewing machine, as is disclosed in the above referenced patent of Ketterer. The hollow looptaker shaft 30 is concentric with the bearing rib 20 of the looptaker 10 and is perpendicular to the internal base portion 24 and to the external base portion 28 of the looptaker. The internal base portion 24 of the looptaker 10 is further fashioned with a raised central portion 31 concentric with the hollow looptaker shaft 30 and having a circular top land 32 perpendicular to the axis of the looptaker shaft. The sides 33 of the raised central portion 31 taper to the internal base portion 24 at an angle of approximately 30° except for a segment 34, of approximately 60°, which tapers at a 10° angle. The segment 34 begins at a radial line of the looptaker 10 extending through the loop seizing beak 22 thereof, and extends in a counter-clockwise direction for approximately 60°; and therefore precedes the loop seizing beak, which rotates in a counter-clockwise direction (see FIGS. 3 and 4). The internal base portion 24 is further fashioned with a milled slot 36 extending substantially on a radial line from the edge of the top land 32 to the circumferential opening 25. The radial line extending through the milled slot 36 is situated approximately 30° clockwise of the radial line extending from the center of the hollow looptaker shaft 30 through the loop seizing beak 22. The milled slot 36 is further fashioned with a tapped hole 37 extending from the base of the slot through to the external base portion 28 (see FIGS. 5 and 6).

Those parts of the looptaker 10 thus far described which come in contact with needle thread or bobbin thread (as will be described below) are given a thread handling finish. The parts of the looptaker 10 thus finished include the bearing rib 20, the loop seizing beak 22 formed as part of the bearing rib, the raised central portion 31 including the top land 32 tapering sides 33 and segment 34 and the milled slot 36. Thus the looptaker 10 is a finished part requiring no further treatment before introduction into the sewing machine for use as a thread handling part.

In FIGS. 3 through 6 there is shown in greater detail the bobbin thread pull-off 40, subject of this invention. The bobbin thread pull-offff 40 is L-shaped with a reentrant angle between the leg 42 and an upstanding portion 45 thereof. The leg 42 is of such a width to fit closely within the milled slot 36, and is of such a height that no portion of it will extend above the internal base portion 24 when seated in the milled slot 36. The leg 42 is further fashioned with a tapered hole 43 designed to receive a flat-head machine screw 41, threadable into the tapped hole 37 in the looptaker 10. When the bobbin thread pull-off 40 is held retained to the looptaker 10 by the flat-head machine screw 41 extending through the leg 42 thereof, the upstanding portion 45 is disposed radially inwardly of the leg, within and extending above the raised central portion 31 of the looptaker (see FIG. 6). The upstanding portion 45 has a top edge 44, the trailing part of which is formed as a hook 46 the purpose of which will be explained below. The bobbin thread pull-off 40 and machine screw 41 are also given a thread handling finish prior to assembly to the looptaker 10, the assembly of looptaker and pull-off requiring no further treatment prior to introduction into a sewing machine.

The bobbin case 18 is formed with an upwardly open cavity 52 to accommodate a bobbin 48 therein. The bobbin case 18 is further formed with a bearing flange 54 over most of its periphery, which rests on the bearing rib 20 on the looptaker 10 (see FIG. 2). The bearing flange 54 is discontinuous in a first portion 56 of its periphery to accommodate passageway of the needle 12 between the bobbin case and the bearing rib 20 and loop seizing beak 22. The body of the bobbin case 18 is further relieved in this particular area to accommodate the throw of the sewing needle 12 to bottom dead center. The bearing flange 54 of the bobbin case 18 is discontinuous in a second portion opposite the first portion 56 (see FIG. 2) to accommodate a thread tensioning spring bracket 58 attached to the bobbin case by screw 59 (see FIG. 1). A down-turned arm 60 of the thread tensioning spring bracket 58 extends adjacent the outside of the bobbin case 18, and supports a bobbin thread tension spring 62 thereon. The bobbin case 18 is fashioned with a circular opening 64 extending therethrough from the bottom of the cavity 52, into which extends an annular protruberance 49 on the bottom flange 50 of the bobbin 48; this arrangement maintaining the bobbin in axial alignment with the shaft 30 of the looptaker 10. Between a top flange 51 and the bottom flange 50 of the bobbin 48, a lower or bobbin thread, B, is wound and extends through an opening provided therefor in the thread tensioning spring bracket 58, to be captured between the bobbin thread tension spring 62 and the spring bracket, thereupon passing beneath the bobbin case 18 to the opposite side of the bobbin case and up through the relief and the discontinuity in the first portion 56 of the bearing flange 54. Further details of this construction may be had by reference to the above referenced patent of Ketterer, which differs from this disclosure only in readily apparent detail.

Figure 1:
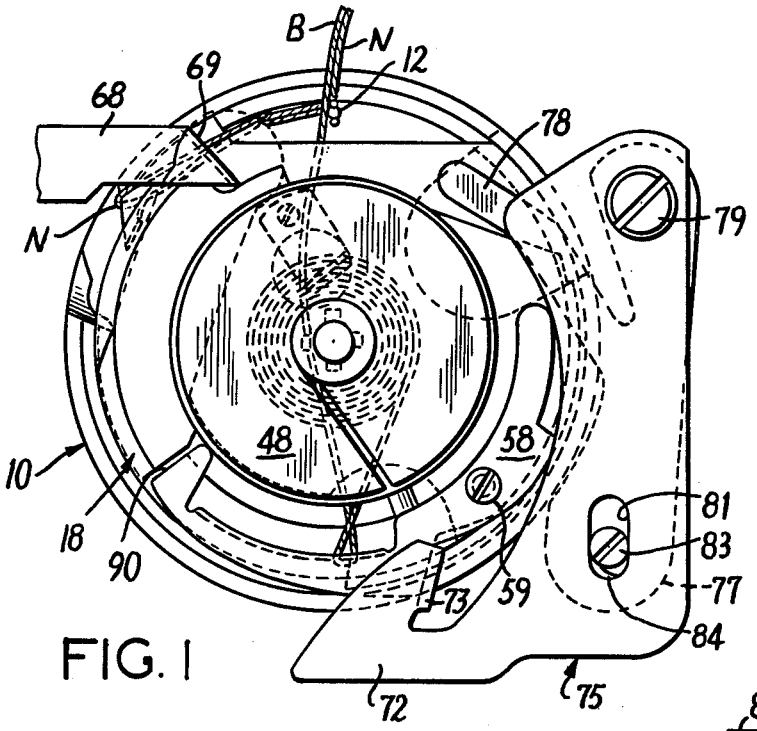
Referring to FIG. 1, there is shown a top plan view of the rotary looptaker 10, supporting internally thereof a bobbin case 18, and mechanism restraining the bobbin case from rotation with the looptaker. The looptaker 10 has an upwardly open cup-shape form with an annular inwardly extending bearing rib 20 situated close to its upper edge. A narrow upwardly open slot 21 extends through the upper edge of the looptaker and bearing rib 20 and forms at one side with the bearing rib a needle thread loop seizing beak 22 (see FIGS. 3 and 4).

Referring to FIG. 1, there is shown a rotation restraining element 68 which is attached to the sewing machine frame. The rotation restraining element 68 is fashioned with a down-turned arm 69, the arm extending into engagement with a wall 57 (see FIG. 2) adjacent the discontinuity through the first portion 56 of the bearing flange 54. There is a second rotation restraining element 72 having a down-turned arm 73 which is in engagement with an edge of the thread tensioning spring bracket 58. The second rotation restraining element 72 is part of a first base plate 75 which, together with a second base plate 77, is pivoted to the sewing machine frame on a shouldered screw 79. Both the first base plate 75 and the second base plate 77 are fashioned with overlapping slot 81, opposite the pivoted end thereof, through which extends the eccentric head 83 of a locating pin 84 whose position may be fixed relative to the sewing machine frame by set screw (not shown). The second base plate 77 is fashioned with a laterally extending hold-down spring arm 78 overlying the bobbin case 18.

Figure 2:
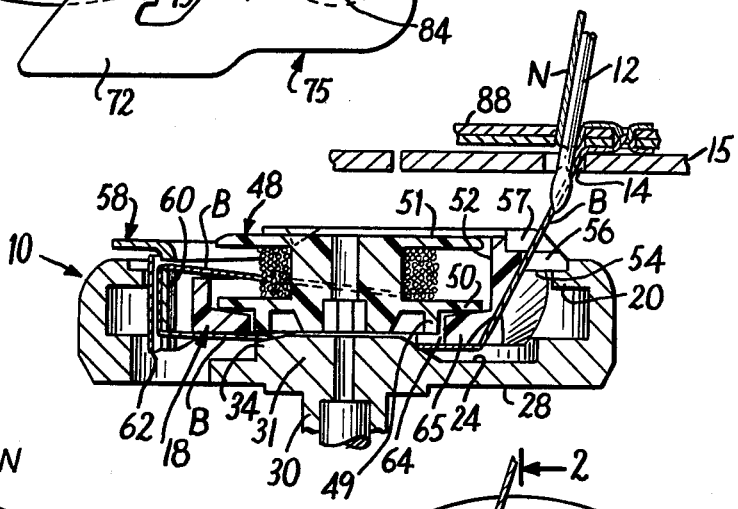
Figure 3:
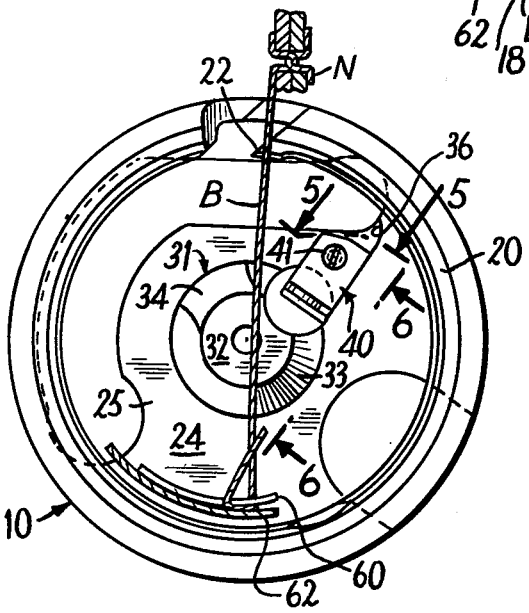
Figure 4:
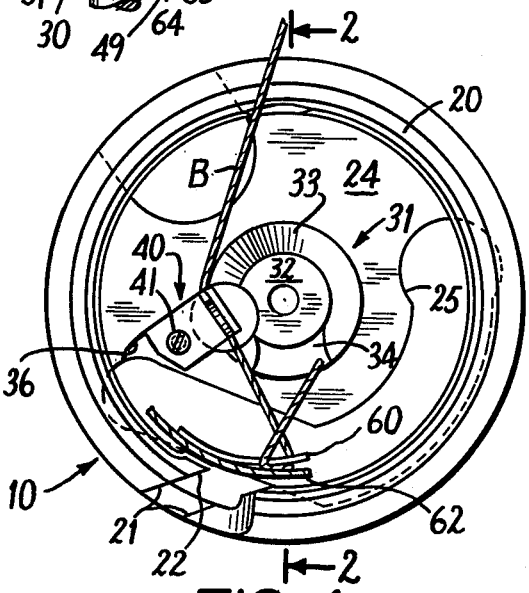

The operation of this bobbin thread pull-off 40 in the looptaker 10 can be explained by reference to FIGS. 1 through 4. As was explained above, the looptaker 10 partakes of two revolutions for each endwise reciprocation of the sewing needle 12. Thus the loop seizing beak 22 of the looptaker 10 and the bobbin thread pull-off 40 make an active pass during one revolution, and an idle or inactive pass during the second revolution. In FIGS. 2 and 4, the looptaker 10 is shown in cross section and plan, respectively, during an active pass after the sewing needle 12 was passed through a work material 88, but prior to reaching bottom dead center of its stroke and undergoing retrograde motion necessary to throw a loop for seizure by the loop seizing beak 22. As shown in FIG. 2, the bobbin thread, B, contained on bobbin 48, passes between the bobbin thread tension spring 62 and the down-turned arm 60 of the tensioning spring brackets 58 and extends beneath the bobbin case 18 to the stitching point on the other side of the bobbin case, and then up to the work material 88. A projection 65 on the underside of the bobbin case 18 forces the bobbin thread, B, to take a path below the top land 32 of the raised central portion 31 of the looptaker 10. The bobbin thread, B, thus extends into the path of the upstanding portion 45 of the bobbin thread pull-off 40, and as may be seen from an inspection of FIG. 4, causes an additional length of bobbin thread, B, to be introduced into the sewing system while simultaneously deflecting the bobbin thread to the left of the sewing needle 12 prior to passage thereof through the work material, thereby obviating half-hitching. Since that limb of the bobbin thread, B, acted on by the thread pull-off 40 extends to the work material 88, the additional thread supply demanded by the thread pull-off will be taken from the bobbin 48 through the tension spring 62.

In continued operation of the sewing machine from the position shown in FIGS. 2 and 4, the sewing needle 12 will proceed to bottom dead center and partake of sufficient retrograde motion to throw a loop of needle thread for seizure by the loop seizing beak 22 of the looptaker 10, which will meanwhile have revolved counterclockwise somewhat more than 180° to a position behind the sewing needle 12. After the loop of needle thread, N, is picked up, a situation as depicted in FIG. 1 ensues. The needle thread loop, N, has been picked up by the loop seizing beak 22, and the sewing needle 12 is in retrograde motion towards top dead center but still extends through the work material 88. The bobbin thread pull-off 40 attached to the looptaker 10 is on an idle pass where it will have little effect on slack bobbin thread, B, introduced during its prior active pass. The needle thread, N, will be carried about the bobbin case 18 by the loop seizing beak 22 of the looptaker 10 and will be cast off the loop seizing beak after passing between the arm 73 of the second rotation restraining element 72 and the thread tensioning spring bracket 58 on the bobbin case, under the urging of the sewing machine take-up as is well know in the sewing machine art. To facilitate this arrangement, the eccentric head 83 of the locating pin 84 is fixed in a position which will permit needle thread, N, seized by the loop seizing beak 22 to pass between the arm 69 of the first rotation restraining element 68 and the wall 57 of the bobbin case 18, and between the arm 73 of the second rotation restraining element 72 and the edge of the spring bracket 58, as is also well known in the sewing machine art. After the needle thread, N, seized by the loop seizing beak 22 has been cast off, the loop seizing beak will continue in an idle pass past the path of needle endwise reciprocation with, however, the sewing needle 12 close to its uppermost position, and out of contact with the work material 88, a situation which is depicted in FIG. 3. As indicated diagrammatically in FIG. 3, the prior stitch is at this time set by the withdrawal of the needle thread, N, by the sewing machine take-up. In actual practice, some additional rotation of the sewing machine instrumentalities may be required to insure stitch setting, in anticipation of which the bobbin thread pull-off 40 is situated approximately 30° behind the loop seizing beak 22 of the looptaker 10. The bobbin thread pull-off 40 supported on the looptaker 10 will, on continued counter-clockwise rotation of the looptaker from the position shown in FIG. 3, have a pull-off edge 47 thereof engaged with the bobbin thread, B, to draw further slack therefrom after the prior stitch is set, to reach a position as shown in FIG. 4.

Figure 9:
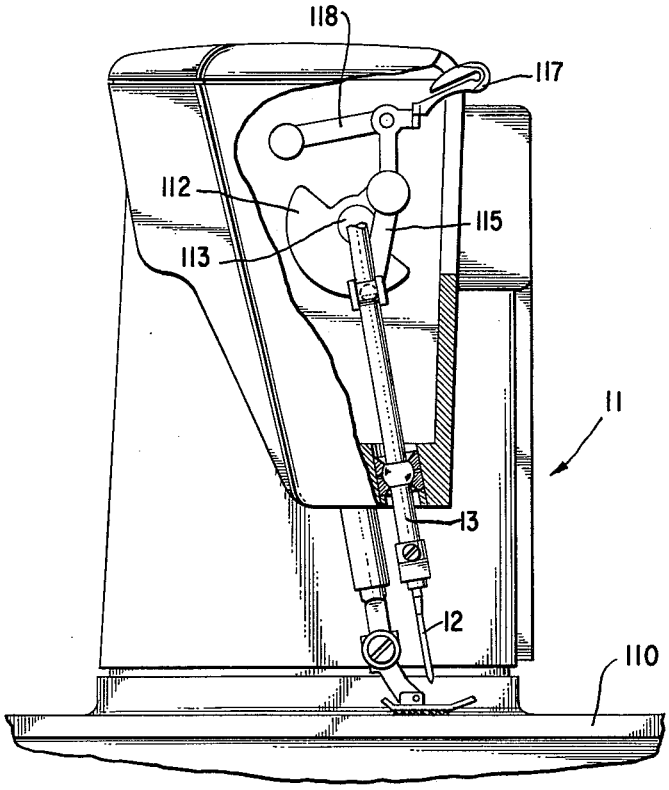

In FIG. 9 is shown a partial head end elevation of a sewing machine 11, in which is supported for endwise reciprocation a needle bar 13 terminating in the sewing needle 12. The looptaker 10 is supported in the bed 110 of the sewing machine 11 in a position for cooperation with the sewing needle 18 in the formation of lockstitches. The needle bar 13 is caused to undergo endwise reciprocation under the urging of a crank 112 supported on the end of an arm shaft 113, the crank being pivotally connected to one end of a driving link 115 having its other end connected to the needle bar, all in a manner well known in the sewing machine art.

Also connected to the crank 112 is one end of a take-up lever 117, centrally supported by an idler link 118 pivoted on the sewing machine 11. The take-up lever 117 moves in a substantially vertical path in synchronism with the needle bar 13 and needle 12, providing the needle thread required to enlarge the loop picked up by the loop seizing beak 22 of the looptaker 10 and cast it about the bobbin case 18 and bobbin 48, and to withdraw this enlarged loop once cast about the bobbin case and bobbin. The takeup lever 117 is shown in its uppermost position where it is also effective to set or lock the stitch in place, i.e., to draw the bobbin thread up into place, pull work material together and to remove all slack thread. When the take-up lever 117 is in its uppermost position as shown in FIG. 9, the looptaker 10 is in position as shown in FIG. 3, which also shows, diagrammatically, a lock stitch set in place.

In a situation where a fully wound bobbin 48 is introduced into the bobbin case 18, an end of bobbin thread, B, must be drawn through slot 90 at the juncture of the bobbin thread tensioning spring bracket 58 and bobbin case 18 and pulled to the right as viewed in FIG. 1 to lay above the first base plate 75. As a loop of needle thread, N, is drawn by the loop seizing beak 22 of the looptaker 10 about the bobbin case 18, the bobbin thread, B, will be drawn to a position beneath the bobbin case 18 between the tensioning spring bracket 58 and the tension spring 62. Normally in this situation the bobbin thread lead will be to the right of the raised central portion 31 of the looptaker 10, and must be drawn to a position as is shown in FIGS. 1, 3 and 4 in order to be acted on by the bobbin thread pull-off 40. For this purpose the hook 46 in the bobbin thread pull-off 40 has been provided. The position of the bobbin thread pull-off 40 will be somewhat clockwise of that shown in FIG. 3, and the bobbin thread, B, will also lay to the right. The bobbin thread pull-off 40 will have the pull-off edge 47 thereof somewhat less effective to urge the bobbin thread lead to the left due to the thread handling finish given to the pull-off. It has been found, however, that the hook 46 on the bobbin thread pull-off 40 will operate to draw the bobbin thread, B, to the left. The segment 34 of the tapering sides 33 of the raised central portion 31 of the looptaker 10 operates to discourage the bobbin thread, B, from being caught by the pull-off edge 47 of the bobbin thread pull-off 40 when located opposite the path of reciprocation of the sewing needle 12 in the location shown in FIG. 4 during an idle pass. The segment 34 is rendered ineffective, however, when located adjacent the line of reciprocation of the sewing needle 18 by the extension 65 to the bobbin case 18 forcing the bobbin thread, B, from the segment 34 as seen in FIG. 3 into the path of the pull-off edge 47 of the bobbin thread pull-off 40.

Figure 7:
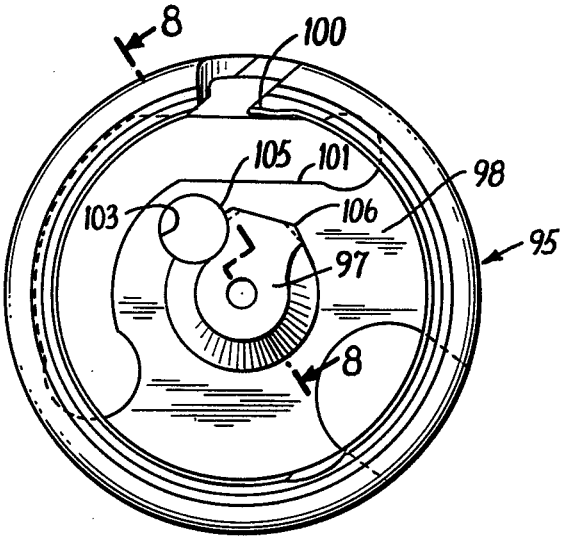
PRIOR ART FIG. 7
Figure 8:
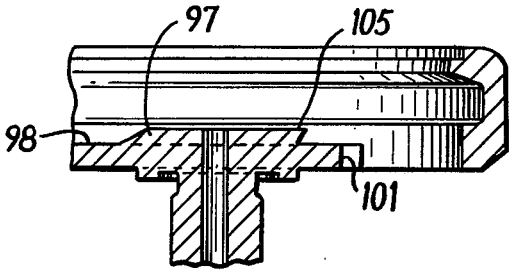
PRIOR ART FIG. 8

Thus has been described a looptaker 10 separately finished as a thread handling part to which is attached a bobbin thread pull-off 40 by means of flat-head screw 41, which are also separately given a thread handling finish, to form a completed assembly which may be installed in a sewing machine without any further treatment. The advantages thus achieved may be appreciated by an inspection of the prior art device shown in FIGS. 7 and 8. The prior art looptaker 95 is fashioned with a raised central portion 97 on an internal base portion 98, the raised central portion extending towards a loop seizing beak 100. The prior art looptaker 95 contains a circumferential opening 101 in order to accommodate the dip of a sewing needle 12. A hole 103 extends through the raised central portion 97 and internal base portion 98 in a fashion to form a point 105 in the raised central portion. A cross section taken along line 8—8 of FIG. 7 and shown in FIG. 8 indicates that this point 105 is undercut to form a bobbin thread accommodating groove. A similar thread accommodating groove is formed in a section 106 of the raised central portion 97 adjacent to and trailing the point 105. The thread accommodating groove of point 105 and section 106 perform the same operation of bobbin thread pull off as is achieved by the device of this invention. In order to achieve this, however, the thread accommodating groove must be carefully prepared by a hand stringing operation to avoid sharp corners on the point 105 or the section 106 which would cut and fray the bobbin thread as the pull off action takes place. The sensitivity of this hand stringing operation thus created considerable manufacturing expense. Also, in this prior art looptaker 95, the thread pull-off was effected by the point 105 which precedes the loop seizing beak 100 of the looptaker, causing bobbin thread pull off to be effected prior to stitch setting. In the device of this invention, the bobbin thread pull-off 40 is located after the loop seizing beak 22, stitch setting taking place when the sewing machine take-up reaches its highest point prior to bobbin thread pull off.

Thus has been explained, the operation of a bobbin thread pull-off which may be given a thread handling finish prior to attachment to a looptaker, also previously given a thread handling finish, which may be assembled into a sewing machine with little or no further treatment. The timing of bobbin thread pull off relative to stitch setting has been advantageously modified. Also, a sensitive manufacturing operation has been eliminated thereby saving the expense of that operation and the losses incurred thereby.

It is evident that the invention will find utility in lockstitch looptakers other than that described, such as, for example, horizontal axis looptaker or inclined axis looptaker.

Having thus set forth the nature of the invention, what is claimed herein is:

1. A lockstitch forming looptaker for a sewing machine having a thread carrying needle which is endwise reciprocal in a path cooperating with said looptaker through a needle aperture in a work supporting plate and thread take-up means synchronized with said endwise reciprocal movement of said thread carrying needle for setting a stitch at one position and for controlling needle thread at other positions, said looptaker comprising a circularly moving looptaker body with a needle thread loop seizing beak and formed with an annular raceway for accommodating a bobbin case constrained against motion with said looptaker, said bobbin case being of a variety having thread guiding means thereon located opposite the point of seizure of said needle loop by said looptaker beak for directing a bobbin thread from a bobbin accommodating cavity in said bobbin case in a path from said thread guiding means to said needle aperture in said work supporting plate between said stationary bobbin case and said circularly moving looptaker body, and separable bobbin thread manipulating means attachable to said looptaker body in a position to act on said bobbin thread after setting said stitch at said one position of said take-up means and prior to endwise passage of said sewing needle through said needle aperture toward said looptaker body for urging said bobbin thread into a preferred orientation with respect to said sewing needle to preclude half hitching and for drawing a supply of bobbin thread from said bobbin accommodating cavity.

2. A looptaker as claimed in claim 1 wherein said separable bobbin thread manipulating means includes an edge of a lug having a thread handling finish and arranged to extend into said path of bobbin thread extending from said thread guiding means to said needle aperture in said work supporting plate.

3. A looptaker as claimed in claim 2 wherein said lug includes means thereon for drawing an end of said bobbin thread to a position where it can be acted on by said edge of said lug.

* * * * *